US006249259B1

(12) United States Patent
Goodman et al.

(10) Patent No.: US 6,249,259 B1
(45) Date of Patent: Jun. 19, 2001

(54) DOWNHOLE MAGNETIC DIPOLE ANTENNA

(75) Inventors: William L. Goodman, Los Altos Hills; Mark Sweeny, Belmont, both of CA (US)

(73) Assignee: Gas Research Institute, Chicago, IL (US)

( * ) Notice: Subject to any disclaimer, the term of this patent is extended or adjusted under 35 U.S.C. 154(b) by 0 days.

(21) Appl. No.: 09/409,222

(22) Filed: Sep. 30, 1999

(51) Int. Cl.[7] ..... H01Q 7/08
(52) U.S. Cl. ..... 343/788; 343/787; 340/854.6
(58) Field of Search ..... 343/788, 789, 343/790, 787; 324/303; 340/854.5, 854.6, 854.3

(56) References Cited

U.S. PATENT DOCUMENTS

| | | | | |
|---|---|---|---|---|
| 3,967,201 | | 6/1976 | Rorden . | |
| 4,536,714 | * | 8/1985 | Clark | 324/338 |
| 4,637,480 | | 1/1987 | Obrecht et al. . | |
| 4,691,203 | | 9/1987 | Rubin et al. . | |
| 4,800,385 | | 1/1989 | Yamazaki . | |
| 4,812,812 | | 3/1989 | Flowerdew et al. . | |
| 4,980,682 | | 12/1990 | Klein et al. . | |
| 5,103,177 | | 4/1992 | Russell et al. . | |
| 5,130,706 | | 7/1992 | Van Steenwyk . | |
| 5,331,331 | | 7/1994 | Wu . | |
| 5,491,488 | | 2/1996 | Wu . | |
| 5,757,186 | * | 5/1998 | Taicher et al. | 324/303 |
| 5,914,598 | * | 6/1999 | Sezginer et al. | 324/303 |
| 5,923,167 | * | 7/1999 | Chang et al. | 324/303 |

* cited by examiner

*Primary Examiner*—Don Wong
*Assistant Examiner*—Ephrem Alemu
(74) *Attorney, Agent, or Firm*—Pauley Petersen Kinne & Fejer

(57) ABSTRACT

A downhole magnetic hollow core dipole antenna has a high permeability material magnetic core composed of laminated sections placed around a section of drill pipe and running substantially along the length of the pipe. The magnetic core is then surrounded by electrically conductive windings, which in turn are surrounded by a protective sleeve which, if conductive, is split to prevent power-robbing eddy current generation.

22 Claims, 2 Drawing Sheets

DOWNHOLE MAGNETIC DIPOLE ANTENNA

FIELD OF THE INVENTION

This invention is directed to a magnetic dipole antenna for use downhole in gas and oil wells. The invention also includes a well bore system which includes the downhole magnetic dipole antenna.

BACKGROUND OF THE INVENTION

The technology of drilling gas and oil wells has advanced significantly in recent years. Part of this advancement involves new and improved techniques for drilling non-vertical (i.e. horizontal and other directional) wells. One advantage of horizontal and other directional drilling is that it enables a greater portion of the well bore to be exposed to gas or oil-producing strata, which tend to be disposed more horizontally than vertically. This enables more gas or oil to be produced from the directional well, than from a similar vertical well.

When drilling non-vertical well bores, it is common practice to use downhole sensors to measure the orientation of the well bore. The well orientation information gathered during drilling must be transmitted to the surface. Conventional downhole sensors used to measure well orientation include a three-axis accelerometer used to measure roll and inclination of the well bore, and a three-axis magnetometer (which functions as an electronic compass) to measure the well bore azimuth. Information on the well bore has been transmitted to the surface of the earth using a wireline, a measurement while drilling (MWD) mud pulser, or an electric dipole.

The conventional transmission methods and devices have certain disadvantages. Wireline systems, which use a coaxial high strength cable to connect the downhole sensors to the surface, require the use of a wireline truck. Wireline trucks are expensive, both to buy and operate. Also, the wireline must be cut and reconnected to enable the insertion of drill pipe at the surface as the well is drilled down.

MWD methods require changing the downhole fluid dynamics to propagate pressure pulses to the surface. The pressure pulses are used to encode the downhole information. MWD systems are expensive to buy and operate, and do not work well in some formations which the circulation is lost or poor.

The electric dipole transmission method creates a downhole dipole by electrically isolating a portion of the drill pipe and impressing a voltage across it. This method is relatively simple and inexpensive. However, the technique does not work when there is a moderately conducting formation above the dipole, which shorts the dipole signal. Also, this technique cannot be used inside casing, because casing shorts out the signal.

Magnetic dipole antenna transmission has been proposed to eliminate the above shortcomings but has yet to be perfected for practical usage.

Thus, there is a need or desire for a technique for transmitting downhole data to the surface via a magnetic dipole antenna which is relatively simple and inexpensive, provides strong signal and which can be used in a wide variety of environments.

SUMMARY OF THE INVENTION

The present invention is a method and apparatus for transmitting downhole data to the surface using a magnetic dipole. The magnetic dipole has the advantages of the electric dipole technique of being simple and inexpensive to use. Yet the magnetic dipole eliminates the disadvantage of short circuiting in certain environments.

The magnetic dipole includes an elongated metallic cylinder composed of laminations with high magnetic permeability, and an excitation coil wound around the cylinder. The cylinder can be fastened around a drill pipe for mechanical strength, wrapped with excitation coils and covered with a thin protective sleeve. The sleeve is preferably split longitudinally when composed of a conductive material. The dipole is preferably about as long as a section of drill pipe, e.g. ten meters, because this increases its strength.

The dipole can be energized by a supply of electricity removed from the dipole location by several dipole lengths. The supply of electricity can be at, above or below the earth's surface, and can be connected to the dipole by an electric transmission wire. At least one orientation sensor capable of measuring well bore orientation (e.g. inclination and azimuth) is provided in electronic communication with the dipole.

Data on the well bore can be transmitted to the surface by energizing the dipole and employing phase shift key (PSK), or other known modulation techniques. The dipole can be energized with a frequency of about 2 to about 10 Hz, and preferably about 3 Hz for instance. The magnetic downhole transmission power and duration can be enhanced over standard battery pack power by employing a downhole hydraulic power generator.

Magnetic signals from the dipole can be detected at the top of the bore hole using a magnetic field sensor. More than one sensor can be used for increased accuracy to reduce environmental noise and increase range.

With the foregoing in mind, it is a feature and advantage of the invention to provide a magnetic dipole antenna for improved downhole monitoring of the orientation of a well bore during drilling of a gas or oil well.

It is also a feature and advantage of the invention to provide an improved method for monitoring the orientation of a well bore during drilling of an oil or gas well.

It is also a feature and advantage of the invention to provide a well which includes an improved magnetic dipole antenna in a downhole location.

The foregoing and other features and advantages of the invention will become further apparent from the following detailed description of the presently preferred embodiments, read in conjunction with the accompanying drawings. The detailed description and drawings are intended to be illustrative rather than limiting, the scope of the invention being defined by the appended claims and equivalents thereof.

DESCRIPTION OF PREFERRED EMBODIMENTS

Figure 1:
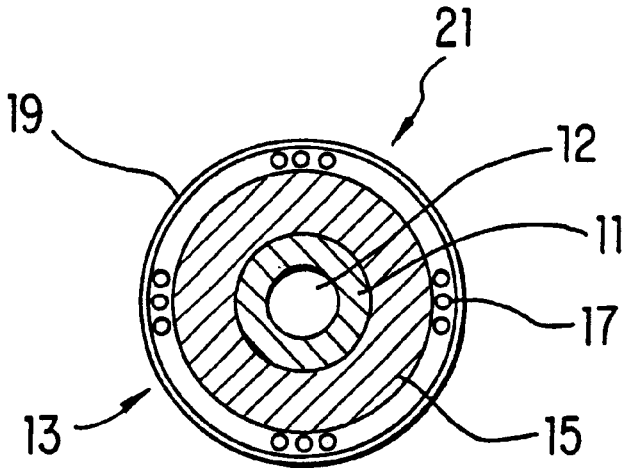
FIG. 1 is a transverse cross section of a downhole magnetic dipole antenna according to one embodiment of the present invention.

Referring to FIG. 1, a drill pipe 11 having a central bore 12 is fitted with a hollow core magnetic dipole antenna assembly 13 having a laminated magnetic core 15 surrounding the drill pipe 11. Surrounding the magnetic core 15 are windings 17 for inducing a field into the magnetic core 15. Surrounding the windings 17 is an outer protective sleeve 19. It will be appreciated that FIG. 1 is somewhat schematic and that the scale of parts, arrangement of windings, etc., will be constructed and arranged according to known techniques by the ordinarily skilled artisan as desired or necessary to the application.

The antenna of the preferred embodiment is most easily constructed to surround virtually an entire length of drill pipe, giving the antenna a high aspect ratio of length to diameter. The laminated magnetic core 15, as further detailed below, is preferably constructed from high magnetic permeability material such as coated steel laminations to render the core non-electrically conductive. The magnetic core should preferably not conduct to the drill pipe and can be insulated therefrom by known coatings or coverings (not shown). If the outside layer of the magnetic core can conduct to the surrounding layer of the core the inside layer must be electrically insulated from the pipe. The cross sectional area of the magnetic core and the magnetic permeability of the materials may be dictated by practical considerations including performance and cost.

The protective sleeve 19 is selected of material suitable to protect the windings 17 in the drilling environment, and may, e.g., be composed of steel, fiberglass or other suitably abrasion resistant material. If the material of the cover 19 is electrically conductive, the cover 19 should be slotted, as at 21, to prevent a shorted turn from conducting induced eddy currents which would significantly reduce the signal strength of the antennae.

Figure 2:
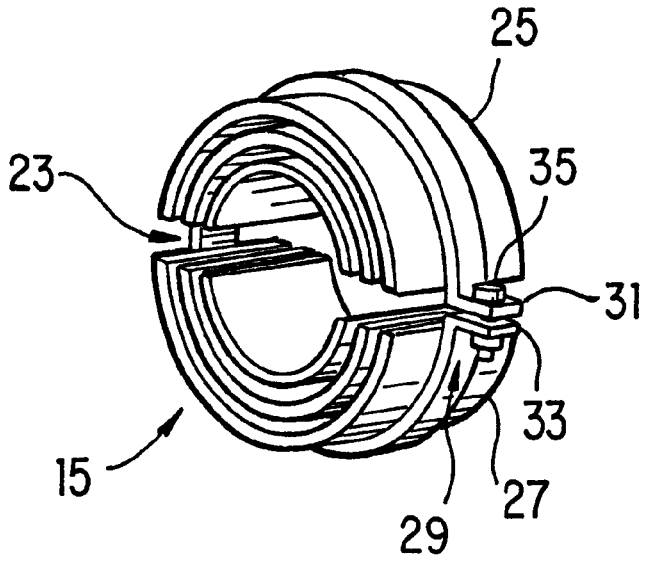
FIG. 2 is a perspective view of one embodiment of the laminated magnetic core of the present invention.

As seen in FIGS. 2 through 5 the laminated core has several alternative constructions. For ease of illustration, FIGS. 2 through 5 show short sections of the long magnetic core 15 of the antennae which surrounds a section of drill pipe 11, as seen in phantom in FIG. 3. If the laminations are made from oriented material, the magnetic-easy axis should be oriented along the length of the antenna. FIG. 2 shows an embodiment in which the laminations, collectively 23, are bent into the form of first and second semicircles 25, 27 with each semicircle covering one-half of the circumference of the drill pipe. The laminations 23 may need to be held in place during construction by means of a strong adhesive, as the laminations are not likely to be bent to the exact radius needed. Also shown is a clamp 29 which can be used during assembly. The two flanges 31, 33 on the clamp would be held together by screws or other means.

Figure 3:
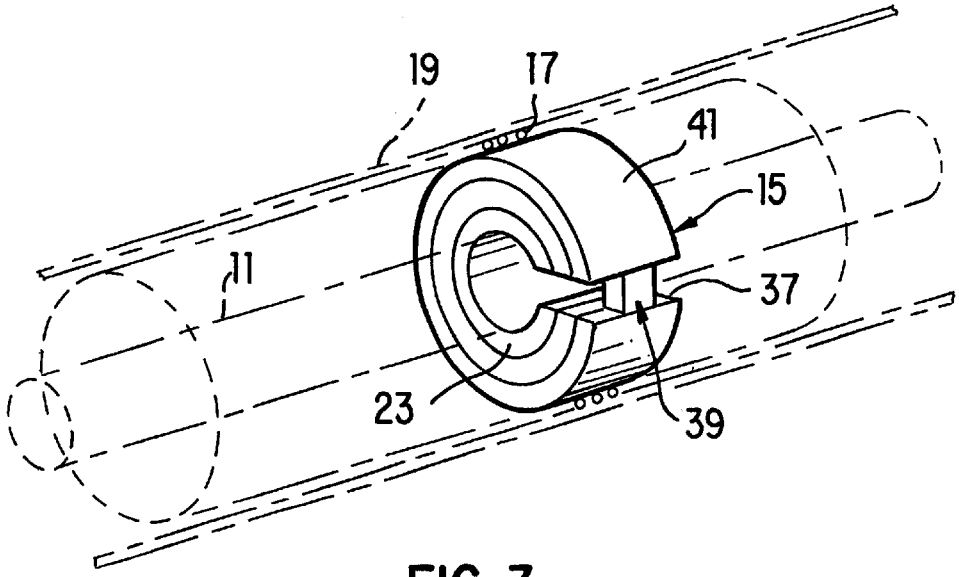
FIG. 3 is a perspective view an alternative embodiment of the laminated magnetic core of the present invention and showing other features of the antenna in phantom.

FIG. 3 shows the case in which the laminations 23 are bent into nearly complete circles, with a gap 37 in the circumference. Also shown is one of a set of spacers 39 applied to the outermost lamination 41. Such spacers could be used during assembly to spread successive outer laminations enough to allow them to be slid over the underlying laminations and drill pipe 11. The spacers could also take the form of a single long strip instead of a set of discrete spacers. This arrangement would usually be glued together, but the laminations would generally be bent to a slightly smaller radius than is needed to fit, so that when the spacers are removed the corresponding lamination would spring tightly to the underlying laminations and drill pipe.

Figure 4:
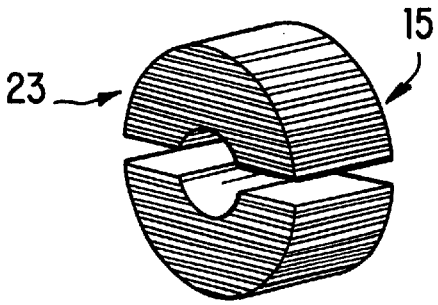
FIG. 4 is a perspective view of an alternative embodiment of the laminated magnetic core of the present invention.

FIG. 4 shows the case in which the laminations 23 are flat strips of varying widths, and all oriented with the flat sides to each other. The stacked laminations are shown to be in two semicircular sections with a space in between. Each section is preferably assembled separately and then the two bound together over the drill pipe as the final step.

Figure 5:
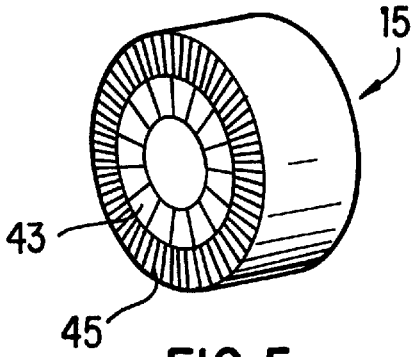
FIG. 5 is a prespective view of an alternative embodiment of the laminated magnetic core of the present invention.

FIG. 5 illustrates the arrangement with the laminations arranged radially out from the central drill pipe. Because the circumference of the magnetic core increases with radius, the laminations achieve a higher packing density if the arrangement is broken into at least two shells 43, 45 as shown. Each shell would contain more laminations along the circumference than the preceding inner shell.

Therefore, it will be appreciated from study of the present invention disclosure that a hollow core magnetic antenna may be utilized without inducing eddy currents to the drill pipe and without reducing fluid flow through the drill pipe. The present antenna provides increased diameter and length of magnetic material added around the drill pipe to provide increased signal strength. Further, by utilizing magnetic material apart from the drill pipe material, the magnetic material may be selected to be of higher magnetic permeability while still utilizing the drill pipe for mechanical rigidity.

We claim:

1. A downhole magnetic antenna comprising:

a) a mechanical support inside a tubular magnetic core;

b) the magnetic core contacting and surrounding the mechanical support, wherein the magnetic core is a cylindrical sleeve composed of high magnetic permeability material laminations; and c) electrically conductive windings surrounding the magnetic core.

2. The antenna of claim 1 wherein the mechanical support is a pipe.

3. The antenna of claim 1 further comprising a protective outer cover surrounding the windings.

4. The antenna of claim 1, further comprising an outer protective cover that is electrically conductive and having a longitudinal split.

5. The antenna of claim 1, wherein the sleeve is composed of two semicircular halves with laminations of each half being bent in semicircular fashion.

6. The antenna of claim 5, wherein the two halves are held by a clamp.

7. The antenna of claim 1, wherein the sleeve is composed of laminations bent annularly into an open ring.

8. The antenna of claim 1, wherein the sleeve is composed of flat laminations of varying width stacked to produce an annular sleeve.

9. The antenna according to claim 8, wherein the annular sleeve is composed of two semicircles.

10. The antenna of claim 1, wherein the sleeve is composed of radially arranged sections of laminate.

11. The antenna according to claim 10, wherein the laminates are arranged in more than one circumferential shell surrounding the pipe.

12. The antenna of claim 2, wherein the pipe is a drill pipe and the magnetic core is electrically insulated from the drill pipe.

13. The antenna of claim 1, wherein the laminations are selected to have a magnetic-easy axis oriented on the longituidinal axis of the magnetic core.

14. A downhole magnetic antenna comprising:

a) a drill pipe;

b) a magnetic core cylindrical sleeve contacting and surrounding the drill pipe, the sleeve being composed of high magnetic permeability material laminations and being electrically insulated from the drill pipe;

c) electrically conductive windings surrounding the cylindrical sleeve; and d) a protective outer cover surrounding the windings.

15. The antenna of claim 14, wherein the protective cover is electrically conductive and has a longitudinal split.

16. The antenna of claim 14, wherein the sleeve is composed of two semicircular halves with laminations of each half being bent in semicircular fashion.

17. The antenna of claim 14, wherein the two halves are held by a clamp.

18. The antenna of claim 14, wherein the sleeve is composed of laminations bent annularly into an open ring.

19. The antenna of claim 14, wherein the sleeve is composed of flat laminations of varying width stacked to produce an annular sleeve.

20. The antenna according to claim 19, wherein the annular sleeve is composed of two semicircles.

21. The antenna of claim 1, wherein the sleeve is composed of radially arranged sections of laminate.

22. The antenna according to claim 21, wherein the laminates are arranged in more than one circumferential shell surrounding the pipe.

* * * * *

UNITED STATES PATENT AND TRADEMARK OFFICE

CERTIFICATE OF CORRECTION

PATENT NO. : 6,249,259 B1 
DATED : June 19, 2001
INVENTOR(S) : William L. Goodman and Mark Sweeny It is certified that error appears in the above-identified patent and that said Letters Patent is hereby corrected as shown below:

Column 6,
Line 6, delete "1" and insert -- 14 --.

Signed and Sealed this

Eleventh Day of June, 2002

*Attest:*

*Attesting Officer*

JAMES E. ROGAN
*Director of the United States Patent and Trademark Office*